US008955539B2

(12) United States Patent
Early et al.

(10) Patent No.: US 8,955,539 B2
(45) Date of Patent: Feb. 17, 2015

(54) PORTABLE STEEL-REINFORCED HDPE PUMP STATION

(76) Inventors: Daniel M. Early, New Castle, VA (US); Scott F. Easter, Huddleston, VA (US)

( * ) Notice: Subject to any disclaimer, the term of this patent is extended or adjusted under 35 U.S.C. 154(b) by 758 days.

(21) Appl. No.: 13/277,973

(22) Filed: Oct. 20, 2011

(65) Prior Publication Data

US 2012/0107137 A1 May 3, 2012

Related U.S. Application Data

(60) Provisional application No. 61/408,282, filed on Oct. 29, 2010.

(51) Int. Cl.
*F16L 5/00* (2006.01)
*E03F 5/22* (2006.01)

(52) U.S. Cl.
CPC ..... *E03F 5/22* (2013.01)
USPC ..... 137/363; 417/36; 417/360; 52/20; 210/170.03

(58) Field of Classification Search
CPC ..... E03F 5/024; E02D 29/12; F04D 29/602; F04D 29/603
USPC ..... 137/363, 364, 368–372; 417/36, 40, 417/360, 361; 52/19–21; 210/170.03, 210/170.08
See application file for complete search history.

(56) References Cited

U.S. PATENT DOCUMENTS

| | | | | |
|---|---|---|---|---|
| 3,715,958 | A * | 2/1973 | Crawford et al. | 52/21 |
| 3,938,545 | A | 2/1976 | Nagy et al. | |
| 3,974,599 | A * | 8/1976 | Grosh | 52/20 |
| 3,999,890 | A * | 12/1976 | Niedermeyer | 417/17 |
| 4,661,047 | A | 4/1987 | Weis | |
| 4,679,991 | A | 7/1987 | Harbison et al. | |
| 5,349,797 | A * | 9/1994 | Stultz | 52/396.05 |
| 5,772,361 | A * | 6/1998 | Gavin | 405/36 |
| 5,906,479 | A * | 5/1999 | Hawes | 417/360 |
| 6,059,208 | A * | 5/2000 | Struthers | 241/46.01 |
| 6,644,342 | B1 | 11/2003 | Bogan et al. | |
| 6,863,807 | B2 | 3/2005 | Crawford, III | |
| 7,011,743 | B2 * | 3/2006 | Use et al. | 210/131 |
| 7,150,290 | B1 * | 12/2006 | Smith | 137/363 |
| 2003/0190742 | A1 | 10/2003 | Whiteman | |
| 2004/0011725 | A1 | 1/2004 | Harle et al. | |

FOREIGN PATENT DOCUMENTS

GB 2189002 A * 10/1987 ..... F16L 9/12

OTHER PUBLICATIONS

Paladex—large bore pipes made of steel reinforced high density polyethylene, http://www.idi-irrigation.com/catalog/product.asp?maincat=3&SubCateaoryId=57&categoryId=11&prodId=316.

* cited by examiner

*Primary Examiner* — Kevin Murphy
(74) *Attorney, Agent, or Firm* — Richard C Litman

(57) ABSTRACT

The portable steel-reinforced HDPE pump station includes a vertically upright, cylindrical wet well fabricated from steel-reinforced plastic. Pumps are disposed in the wet well. A pipe connected to the pumps extends to the outside of the wet well to allow outflow of water to external systems. An access hatch covers the upper portion of the wet well and is arranged above grade. The remainder of the wet well is disposed in the ground, below grade. Vertically disposed sliding rails are attached inside the wet well, and extend upward from a working area of the well to the top of the well near the access hatch. The pumps are slidably attached to the rails to facilitate sliding installation and removal of the pumps by way of the access hatch. A water-receiving inlet pipe extends into the wet well, the inlet pipe allowing entry of water inside the wet well.

7 Claims, 6 Drawing Sheets

PORTABLE STEEL-REINFORCED HDPE PUMP STATION

CROSS-REFERENCE TO RELATED APPLICATION

This application claims the benefit of U.S. Provisional Patent Application Ser. No. 61/408,282, filed Oct. 29, 2010.

BACKGROUND OF THE INVENTION

1. Field of the Invention

The present invention relates to pump stations, and particularly to a portable steel-reinforced HDPE pump station having a wet well made from plastic, preferably high-density polyethylene (HDPE), reinforced with steel.

2. Description of the Related Art

The Roman Empire was the first major ancient civilization to recognize and implement the use of sewers for general sanitation and storm water management. These sewers provided the ability to remove wastewater away from populated areas thereby improving living conditions and reducing the instances of waterborne diseases such as cholera and dysentery. Roman engineers developed sophisticated gravity sewers that conveyed wastewater away from urban areas to local streams and rivers. Since that time, sanitary and storm sewer systems have evolved.

With the advent of gravity sewer as a primary infrastructure component utilized in the development and maintenance of any modern society, there are instances where the use of gravity does not result in the successful conveyance of wastewater or storm water. Topographic conditions, physical improvements, geologic conditions, and property ownership matters may prevent the use of gravity sewers. In these instances, it is necessary to implement other wastewater and storm water conveyance practices. The most common practice is the implementation of a pump station.

A pump station is a device assembled from a variety of mechanical and structural components that, when combined into a working system, will permit the opportunity to convey wastewater from one location to another by mechanical means. The typical pump station configuration would typically collect wastewater at a localized lower elevation and mechanically transport or "lift" the wastewater to a higher elevation. The conveyance of wastewater is accomplished by the connection of the pump station to a wastewater discharge piping system, commonly referred to as a "force main". The forcemain permits the conveyance of wastewater from the pump station to a point of discharge. The point of discharge is typically to a gravity sewer, another pump station, or a wastewater treatment plant or other such facility that would receive wastewater or storm water.

Conventional pump station designs developed and utilized during the past 150 years were typically constructed from steel and/or concrete. These materials were readily available and easily adapted to pump station construction and operation. However, it is fully recognized that these materials, while abundant and reliable, possess drawbacks relative to overall life cycle duration. In particular, wastewater exhibits aggressive corrosion tendencies related to the generation of sulfuric acid that results from the formation of hydrogen sulfide gas.

Gaseous sulfuric acid will attack and corrode concrete and unprotected steel, and after continued exposure and corrosion, will result in a structurally deficient system that can collapse or permit leakage of wastewater to the local environment or permit the intrusion of groundwater into the local sewer system. In any of these instances, the sewer system owner will need to provide significant repairs or total replacement of the steel and concrete systems, which tends to be very costly.

Thus, a portable steel-reinforced HDPE pump station solving the aforementioned problems is desired.

SUMMARY OF THE INVENTION

The portable steel-reinforced high-density polyethylene (HDPE) pump station includes a vertically upright cylindrical wet well fabricated from steel-reinforced plastic. Pumps are disposed in the wet well. A pipe connected to the pumps extends to the outside of the wet well to allow outflow of water to external systems. An access hatch covers the upper portion of the wet well and is arranged above grade. The remainder of the wet well is disposed in the ground below grade. Vertically disposed sliding rails are attached inside the wet well, and extend upward from a working area of the well to the top of the well near the service hatch. The pumps are slidably attached to the rails and attached to a pull chain to facilitate sliding installation and removal of the pumps by way of the access hatch. A water-receiving inlet pipe extends into the wet well, the inlet pipe allowing entry of water inside the wet well. The HDPE pump station may function for wastewater transfer, water conveyance, and irrigation.

Preferably, the tank is equipped with a bottom plate, which serves as an antifloatation collar, thereby preventing inadvertent floatation of an empty tank that may occur during or after construction. The pump station may be pre-assembled, providing a lightweight, rugged pump station that is easily fabricated, easily transported, and easily installed at the project site.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The portable steel-reinforced HDPE pump station provides a pre-assembled pump station that can pump wastewater or clean water for such purposes as wastewater transfer, water conveyance, and irrigation. The pump station is designed to be utilized by public and private sector entities, such as towns, counties, cities, townships, state agencies, federal agencies, private individuals, commercial entities, industrial facilities, and agricultural facilities.

The pump station receives water or wastewater from a variety of conventional sources, such as gravity sewer, water pipes, streams, or other water collection systems. The water or wastewater enters a wet well that is an upright vertical cylinder manufactured from steel-reinforced plastic. The wet well houses one or more pumping systems that will convey water or wastewater by a pipe that connects the pumps to an external piping or water receiving system. Additional internal components may include a slide rail assembly to facilitate the installation and removal of pumps, internal piping that will connect the pump or pumps to external piping, an inlet pipe to receive water, a trash basket to collect trash that can be transported in the water or wastewater, a water level monitoring system that will control pump activation and alarms, and an access hatch in the top of the pump station that will provide access to the internal pump station components. During pump station operation, water enters the pump station and begins to fill the wet well basin. The water level will rise until the level monitor detects the water at a prescribed level. The level monitor signals an external pump control panel that activates the internal pump or pumps. The pumps begin pumping water and discharging the water through the internal pipes, which are connected to an external water receiving system, such as another pipe system, ditch, tank, or other such device or system. When the water level decreases due to pumping action and the level monitor detects water at a prescribed lower water level, the level monitor signals the external pump control panel, which, in turn, deactivates the pump or pumps. The operation is repeated as needed, based upon the water inflow rate into the wet well.

Figure 1:
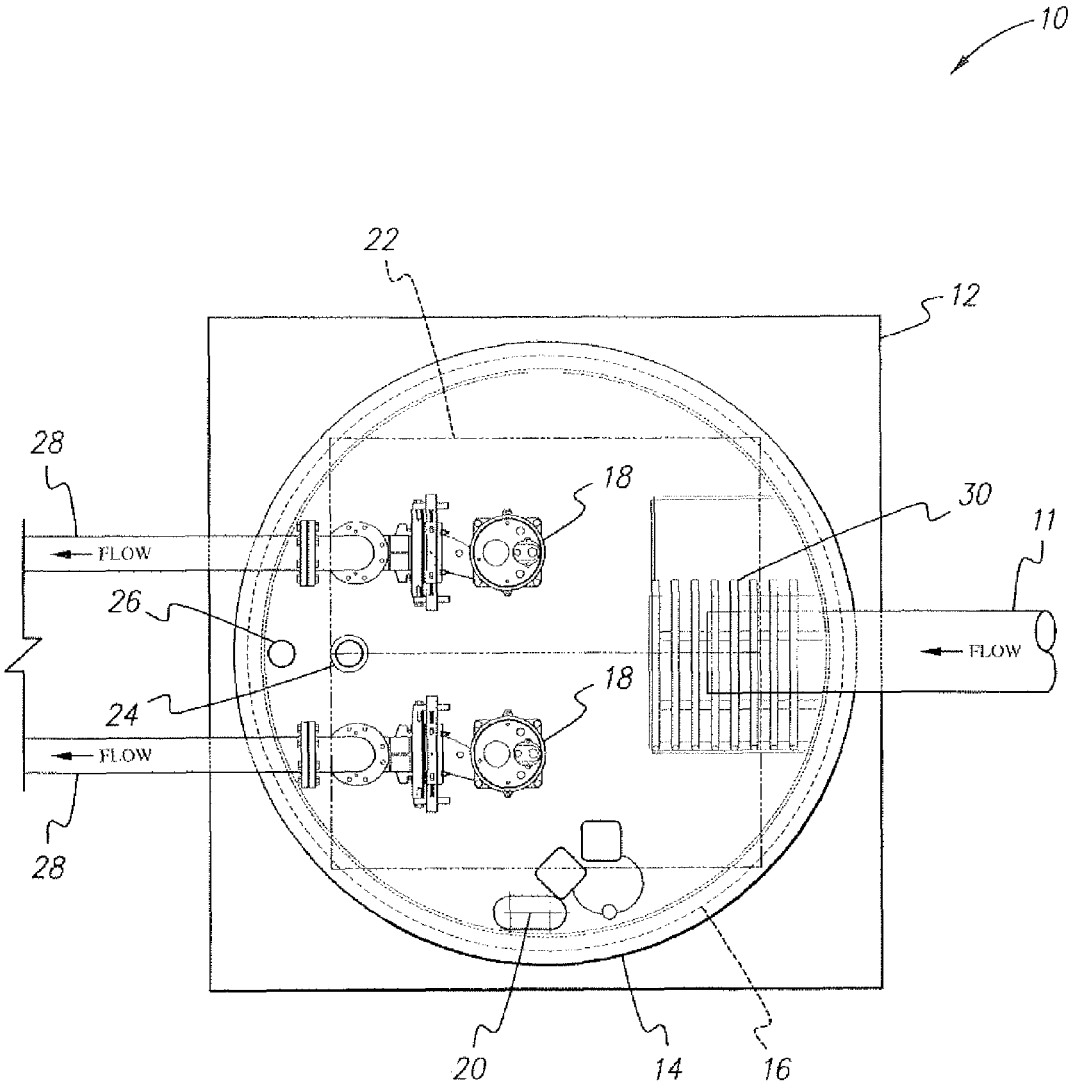
FIG. 1 is a top plan view of the steel-reinforced HDPE pump station according to the present invention, shown with the access cover removed.
Figure 2:
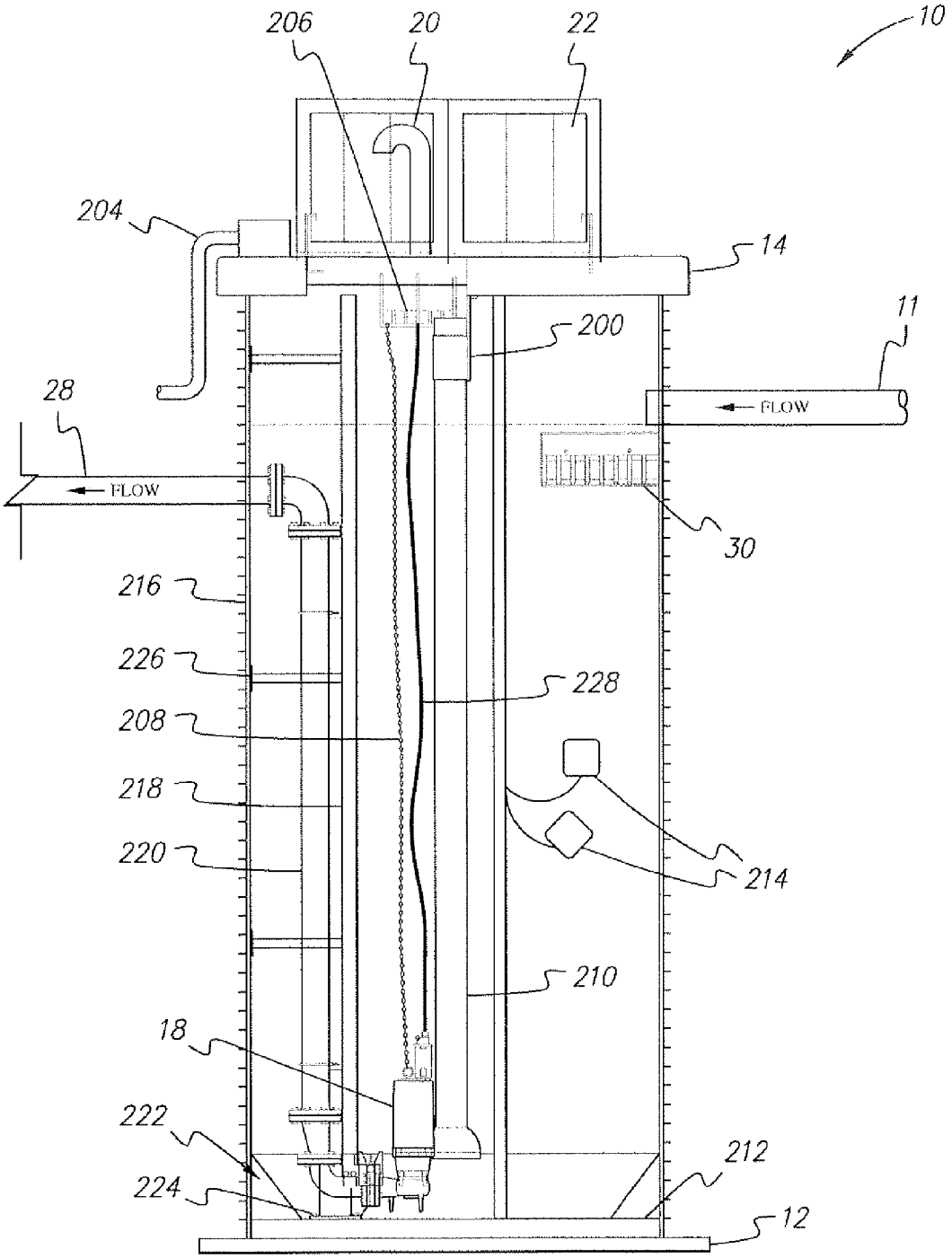
FIG. 2 is a partial, diagrammatic side view of the steel-reinforced HDPE pump station according to the present invention.
Figure 3:
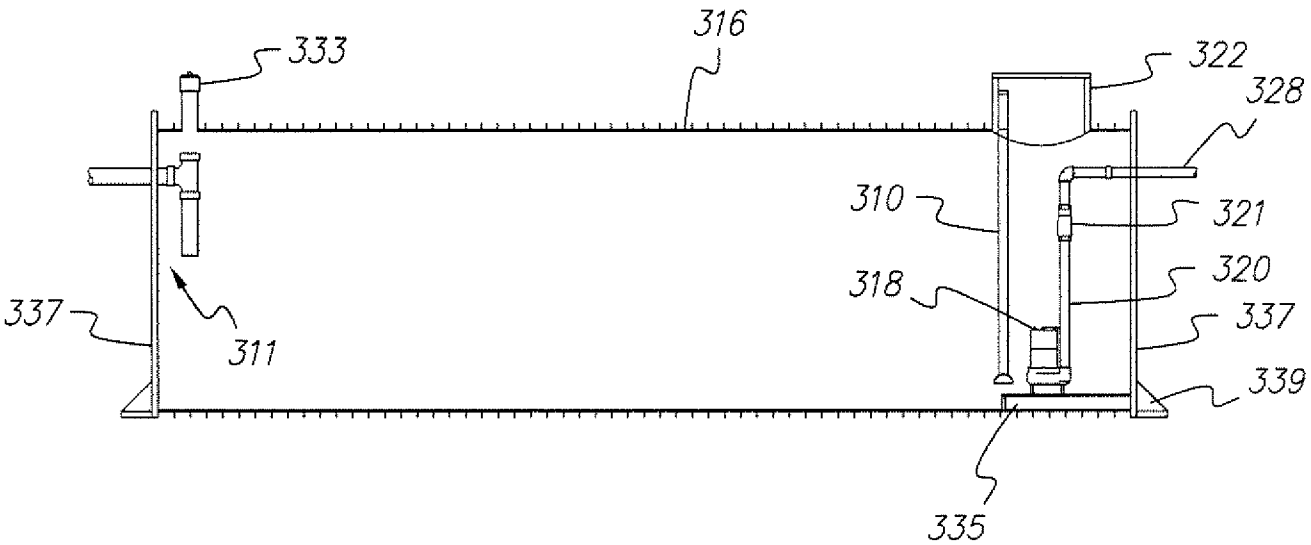
FIG. 3 is a side view of a horizontally oriented steel-reinforced HDPE pump station according to the present invention.
Figure 4:
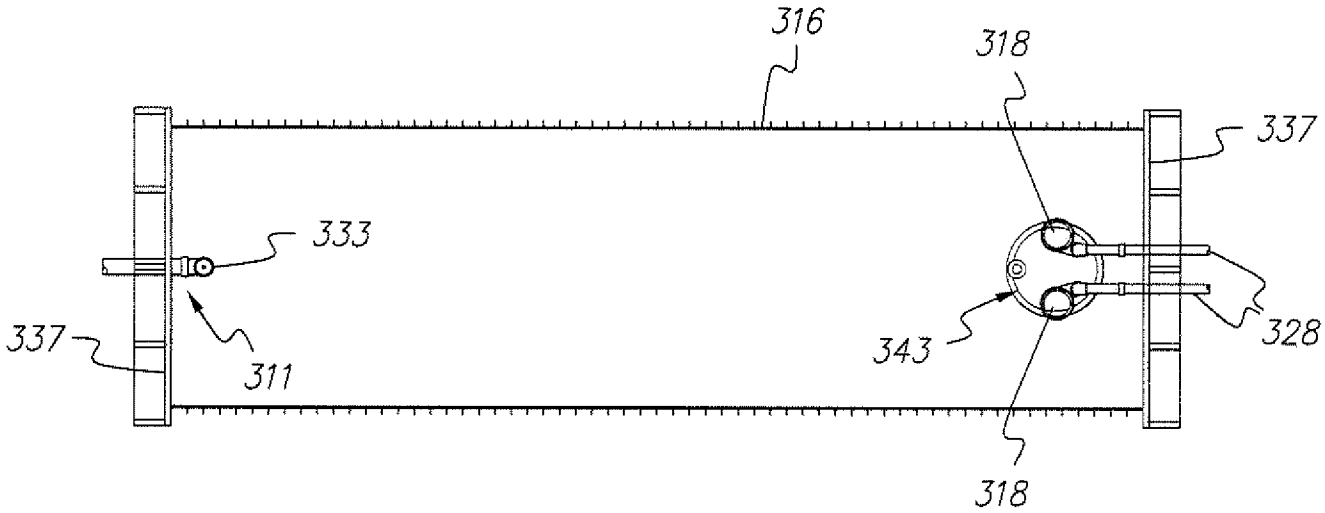
FIG. 4 is a diagrammatic top plan view of the horizontally oriented steel-reinforced HDPE pump station according to the present invention.
Figure 6:
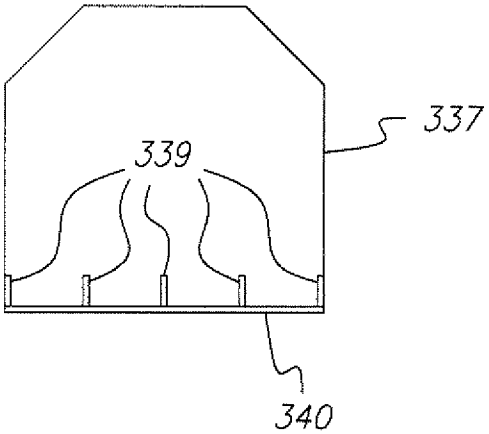
FIG. 6 is a front view of a bulkhead assembly of the horizontally oriented steel-reinforced HDPE pump station according to the present invention.
Figure 5:
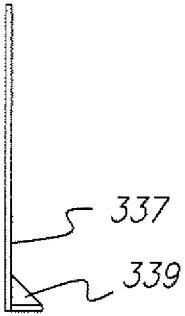
FIG. 5 is a side view of a bulkhead assembly of the horizontally oriented steel-reinforced HDPE pump station according to the present invention.

As shown in FIGS. 1-2, the portable steel-reinforced HDPE pump station 10 includes a wet well 216 made from a steel-reinforced plastic, vertically upright, cylindrical pipe having submersible effluent pumps 18 disposed inside. The pumps 18 are operably connected to flow pipes 28 by pump flange seat assemblies 224 at the bottom of the cylindrical wet well 216. The pipes 28 are partially disposed in the wet well 216 and are connected to their respective effluent pumps 18 by plastic forcemain risers 220. The pipes 28 extend to the outside of the wet well 216 to allow outflow of water to external systems. An access hatch 22 covers the upper portion of the wet well 216 and is arranged above grade. The remainder of the wet well 216 is disposed in the ground, below grade.

Vertically disposed sliding rails 218 are attached to the wall of the wet well 216 inside the wet well 216 by mounting brackets 226, and extend upward from a working area of the well to the top of the well near the access hatch 22. The pumps 18 are slidably attached to the rails 218 to facilitate sliding installation and removal of the pumps 18 by way of the access hatch 22. A pump hoist chain 208 is attached to each pump 18 and disposed through a pump hoist lift socket 26.

The steel-reinforced HDPE wet well 216 has annular corrugations along the exterior sidewall of the wet well. A water-receiving inlet pipe 11 extends into the wet well 216, the inlet pipe 11 allowing entry of water inside the wet well 216. A removable bar screen 30 made from HDPE is disposed below the inlet pipe 11 to capture solids entrained in water flowing through the pipe 11.

The bottom portion of the wet well 216 extends into an HDPE filler block 222 attached to and resting on top of an ultra-high molecular weight (UHMW) plastic anchor block 212, which, in turn, is disposed on top of a substantially square-shaped antiflotation collar 12. The antiflotation collar 12 is preferably made of high-density polyethylene (HDPE) thermoplastic material. The top portion or rim 16 of the wet well 216 extends into an aluminum boilerplate top lid 14. The top lid 14 is annular and fits over the open top portion 16 of the steel-reinforced HDPE cylindrical wet well 216. The overall dimensions and configuration of the pumping station 10 may vary according to pipe diameters available from the manufacturer.

A PVC vent 20 extends upward from the top lid 14 and includes an insect barrier. The vent 20, preferably a four-inch SCH 40 vent, provides fresh air ventilation to the interior of the wet well 216.

A pressure bell pump electronic control assembly 24 is disposed in the wet well 216 between the two effluent pumps 18. The control assembly 24 includes level monitor sensors, which detect the water at a first predetermined level and actuate the pumps 18 at the first predetermined level. When water in the system 10 is detected at a second, lower predetermined level, the pumps 18 are deactivated. Additionally, alarms may further be provided for monitoring water levels and operation of the pumps 18. The sensors are held in place near the top interior center inside of the wet well 216 with stainless steel mounting brackets and bolts 200, which secure the elongate housing of the pressure transducer pump controller 210. The bottom portion of the housing of the pressure transducer pump controller 210 is attached to the pump station 10 in a lower internal portion of the station 10 inside of the wet well 216. An electrical cable 228 is electrically connected to the pumps 18, the cable 228 being routed through a conduit cabling hanger 206 and an electric conduit 204 that extends to a control panel external of the pump station 10. A stainless steel mast includes retrievable floats 214 and extends vertically inside the unit 10, being bolted to the floor and the top of the pumping station 10 inside of wet well 216.

Contech Construction Products, Inc.®, of West Chester, Ohio manufactures a high-density polyethylene (HDPE) piping possessing a steel exterior spiral-ribbed banding that is further encapsulated with a high-density polyethylene plastic, sold under the name Duromaxx™. Such a material, or similar materials, may be used in the manufacture of the wet well 216 to provide increased earth and dynamic load support.

The control panel preferably includes both manual and automatic switches, indicator lights, audible warning horns, visible warning lights, and an optional auto-dialer mechanism that can notify a manned station in the event of a wastewater treatment mechanical problem.

As shown in FIGS. 3-6, a horizontally oriented HDPE wet well 316 can be utilized in environments unsuitable for vertical installations. As most clearly shown in the side view of FIG. 3, the horizontal HDPE wet well 316 has a plastic tee inlet assembly 311 connected to an inlet pipe, which extends outward from a first side of the unit 316. A cleanout inspection port 333 is attached to the wet well and extends upward from a port inspection opening in the wet well proximate the inlet assembly 311. Maintenance access to the inlet assembly 311 can be provided via the cleanout inspection port 333.

Moreover, a pump assembly 318 is positioned inside the wet well 316 near the well's bottom portion, the pump assembly 318 being affixed to an HDPE pump platform 335, which is attached to portions of a lower internal radial surface of the well 316 on the side of the well 316 opposite the inlet assembly side.

An access conduit and hatch assembly 322 covers an access opening 343, and provides maintenance access to a pressure transducer conduit 310, the pumps 318, and the like.

The pressure transducer conduit 310 is clamped to the interior of the tank 316 proximate the access hatch assembly 322. The pressure transducer conduit 310 extends downward to a point proximate the bottom of wet well 316.

A rigid plastic forcemain 320 is connected to and extends upward from the pump assembly 318. There are two plastic forcemains 320, one for each pump of the pump assembly 318. A check valve 321 may be installed in-line with the forcemain 320 as a backflow preventer.

Effluent pipes 328 are connected to the forcemains 320 and exit the well 316 to deliver fluid flow therefrom.

The opposing ends of the wet well 316 are sealed by attachment of two HDPE bulkheads 337. Each HDPE bulkhead 337 is pivotally stabilized by an HDPE stabilization plate 340 disposed across the bottom of the bulkhead 337. Triangular gussets 339 extend from the HDPE stabilization plate 340 at predetermined intervals laterally along the plate 340.

Figure 7:
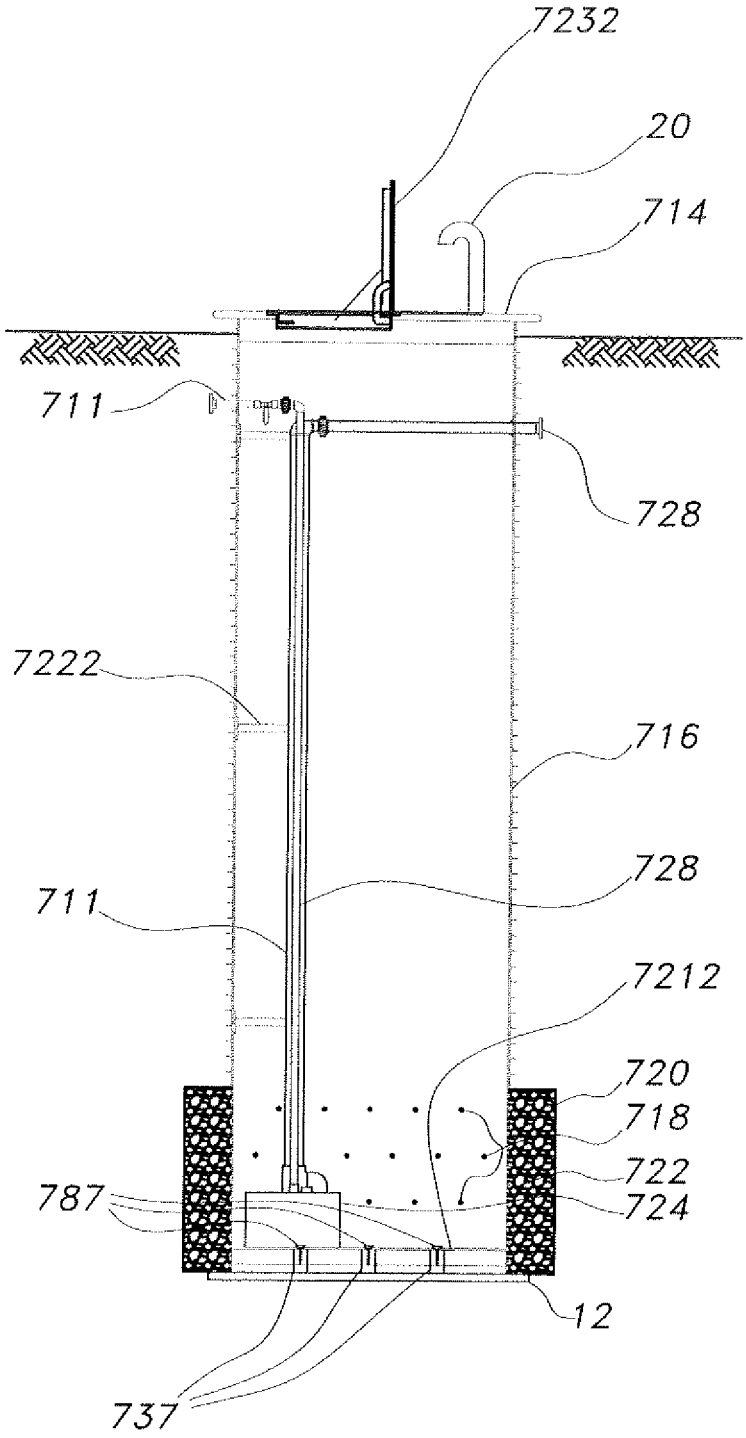
FIG. 7 is a partial, diagrammatic side view of the steel-reinforced HDPE station adapted for use as a cistern according to the present invention.

As shown in FIG. 7, a vertically oriented steel reinforced polyethylene (SRPE) wet well can be utilized as a cistern 716. Hole perforations 718 are disposed in the SRPE wet well cistern 716 near its bottom to facilitate the infiltration of ground water. The wet wall cistern 716 includes a hatch 7232 attached to an HDPE top plate 714, and a vent pipe 20 extending from an HDPE top plate 714. An air inlet line 711 connected to an external blower assembly enters the cistern wall at its top and extends and connects to a positive displacement air lift pump 724 at the bottom of the cistern 716. A positive displacement air lift pump is preferred, but any type of pump is suitable.

An outlet pipe 728 is attached to a pump 724 at the cistern bottom and extends to a top portion of the cistern where it exits the cistern wall. The outlet pipe 728 and air inlet pipe 711 are supported by plastic mounting brackets 7222. The bottom of the cistern 716 includes an HDPE base plate 7212, which rests atop HDPE stiffeners 737, which rest atop an antiflotation collar 12.

HDPE stiffeners 737 extend from and attach to internal opposite sides of the cistern 716 wall and are fuse welded thereto. The HDPE stiffeners 737 are attached by fuse welding to the antiflotation collar 12 and are connected to the base plate 7212 by countersunk fasteners 787 extending through the base plate 7212 into the stiffeners 737. The countersunk holes are filled solid with HDPE material. The base plate 7212 is attached by fuse welding to the cistern 716 wall.

An alternative bottom to the cistern 716 would be the use of a non-compressible filler material between the base plate 7212 and antiflotation collar 12 in lieu of the stiffeners 737. A porous stone/synthetic stone aggregate 722 extends upward from the antiflotation collar 12 and itself collars the perforated region of the cistern 716 A filter fabric 720 covers the aggregate collar 722 and prevents infiltration and clogging of the holes 718 by fine materials.

It is to be understood that the present invention is not limited to the embodiment described above, but encompasses any and all embodiments within the scope of the following claims.

We claim:

1. A portable steel-reinforced high-density polyethylene (HDPE) pump station, comprising:

a vertically upright cylindrical wet well fabricated from steel-reinforced plastic;

at least one pump disposed in the wet well;

an effluent pipe attached to the at least one pump, the effluent pipe extending external to the wet well, the effluent pipe allowing effluent water to exit the wet well, wherein the effluent pipe is comprised of plastic vertically extending forcemain risers interconnecting the effluent pipe to the at least one pump;

an access hatch disposed at an upper portion of the wet well;

sliding rails disposed in the wet well, the sliding rails extending proximate to the access hatch, the at least one pump being slidably attached to the sliding rails, thereby facilitating installation and access to the at least one pump for removal through the access hatch;

an inlet pipe extending into the wet well for receiving water, the inlet pipe providing for entry of water inside the wet well;

a removable bar screen disposed in the wet well proximate the inlet pipe, the bar screen filtering solids from the water emanating from the inlet pipe in the wet well;

a water level monitor disposed in the wet well, the water level monitor activating the at least one pump when water level in the wet well exceeds a first predetermined level and deactivating the at least one pump when water level in the wet well falls below a second predetermined level;

at least one pump flange seat assembly at the bottom of the cylindrical wet well, the at least one pump flange seat assembly operably connecting the at least one pump to the effluent pipe;

a pump hoist lift socket disposed on the wet well;

a pump hoist chain attached to the at least one pump and disposed through the pump hoist lift socket;

a base plate made of HDPE, the bottom portion of the wet well being attached to and extending therefrom;

an Ultrahigh Molecular Weight (UHMW) plastic anchor block, the base plate and the attached wet well resting thereon; and an HDPE antiflotation collar, said UHMW plastic anchor block, the base plate, and the wet well resting atop the collar.

2. The portable steel-reinforced high-density polyethylene (HDPE) pump station according to claim 1, further comprising a PVC vent extending upward from a top portion of said wet well, the PVC vent including an insect barrier.

3. The portable steel-reinforced high-density polyethylene (HDPE) pump station according to claim 2, further comprising means for connecting said water level monitor to an external control panel.

4. A portable steel-reinforced high-density polyethylene (HDPE) pump station, comprising:

a horizontally disposed cylindrical wet well fabricated from steel-reinforced plastic;

an HDPE pump platform attached to the inside portion of the wet well;

at least one pump disposed in the wet well, the at least one pump being attached to the HDPE pump platform;

an effluent pipe attached to the at least one pump, the effluent pipe extending external to the wet well, the effluent pipe allowing effluent water to exit the wet well, wherein the effluent pipe comprises a plastic vertically extending forcemain riser interconnecting the effluent pipe to the at least one pump;

a check valve installed in-line with the forcemain riser as a backflow preventer;

an HDPE riser assembly including an access hatch, the HDPE riser assembly extending upward from an upper radial surface opening of the wet well;

an inlet pipe extending into the wet well for receiving water, the inlet pipe providing for entry of water inside the wet well; and a water level monitor disposed in the wet well, the water level monitor activating the at least one pump when water level in the wet well exceeds a first predetermined level and deactivating the at least one pump when water level in the wet well falls below a second predetermined level;

a port inspection opening in the wet well proximate the inlet pipe;

a cleanout inspection port attached to the wet well and extending upward from the port inspection opening;

an access opening disposed atop the wet well, the opening being approximately inline with the at least one pump;

an access conduit and hatch assembly covering the access opening;

a pair of HDPE bulkheads sealing off two opposing ends of the wet well;

a pair of HDPE stabilization plates disposed across respective bottom portions of the pair of bulkheads; and triangular gussets extending from each of the HDPE stabilization plates at predetermined intervals laterally along the stabilization plates.

5. A portable steel-reinforced high-density polyethylene (HDPE) pump station, comprising:

a vertically upright cylindrical wet well fabricated from steel-reinforced plastic;

at least one pump disposed in the wet well;

an effluent pipe attached to the at least one pump, the effluent pipe extending external to the wet well, the effluent pipe allowing effluent water to exit the wet well;

an access hatch disposed at an upper portion of the wet well;

a base plate made of HDPE, a bottom portion of the wet well being attached to and extending therefrom;

an HDPE antiflotation collar, the base plate and the attached wet well resting atop the collar;

a plurality of HDPE stiffener plates attached to opposing sides of the wet well, the HDPE base plate, and the HDPE antiflotation collar; and a non-compressible filler material inserted between the HDPE base plate and the HDPE antiflotation collar.

6. The portable steel-reinforced high-density polyethylene (HDPE) station according to claim 5, further comprising:

a water inlet pipe extending from exterior to interior of said wet well to provide entry of water inside said wet well.

7. The portable steel-reinforced high-density polyethylene (HDPE) station according to claim 5, further comprising:

holes disposed along a bottom portion of said wet well forming a perforated portion of said wet well;

a stone and synthetic stone aggregate collar surrounding the perforated portion of said wet well for entry of water inside the wet well; and a filter fabric disposed over said stone and synthetic stone aggregate collar.

* * * * *